US005941571A

United States Patent [19]

Wilson et al.

[11] Patent Number: 5,941,571

[45] Date of Patent: Aug. 24, 1999

[54] POCKET LINER

[75] Inventors: Robert B. Wilson, South Hadley; Frederick Christian Schweitzer, Westfield, both of Mass.

[73] Assignee: Specialty Loose Leaf, Inc., Holyoke, Mass.

[21] Appl. No.: 08/950,957

[22] Filed: Oct. 15, 1997

[51] Int. Cl.[6] ..... B42D 15/00; B42D 15/08

[52] U.S. Cl. ..... 281/38; 281/31; 281/37; 402/79

[58] Field of Search ..... 281/31, 37, 38; 402/79

[56] References Cited

U.S. PATENT DOCUMENTS 2,226,976 12/1940 Leaming .
4,232,463 11/1980 Spees .
4,571,867 2/1986 Williams .
4,852,740 8/1989 Sellar et al. .
4,991,767 2/1991 Wyant .
5,029,900 7/1991 Axelrod .
5,199,743 4/1993 Rosinski, III ..... 281/31
5,586,829 12/1996 Schwartz .

FOREIGN PATENT DOCUMENTS 941624 11/1963 United Kingdom .

*Primary Examiner*—Willmon Fridie, Jr.
*Assistant Examiner*—Mark T. Henderson
*Attorney, Agent, or Firm*—Robert A. Seemann

[57] ABSTRACT

In an element for a book which includes a sheet having a slit configured for receiving an item through the sheet, the improvement includes the slit going to two folds of the sheet along fold lines that are transverse to the slit, the folds being at angles that are 90 degrees or less.

15 Claims, 6 Drawing Sheets

POCKET LINER

BACKGROUND OF THE INVENTION

1. Field of the Invention

This invention pertains to folder pockets, more specifically to a slit-opening pocket for heavy or bulky flat objects such as pad stiffeners, packs of paper, and computer diskettes, in a die cut sheet liner for a folder or book cover.

2. Description of the Prior Art

The prior art is replete with patents for a book sheet having a very narrow long slot hereinafter called "slit", pocket opening for insertion of flat objects.

U.S. Pat. No. 2,226,976 patented Dec. 31, 1940 by S. T. Leaming describes a sheet having pairs of upward diverging slits. The outer ends of the slits are spaced from the adjacent edges of the sheet, the lower ends of the slits terminate short of convergency. The outer ends of the slits are enlarged to form entrance openings. The bottom edge of a card that is inserted into a pair of slits first enters the entrance openings and then moves down in the slits until it is stopped by the lower end termination of the slits.

U.S. Pat. No. 4,991,767 patented Feb. 12, 1991 by J. R. Wyant describes a paperboard blank having a transparent plastic overlay. The blank is folded to form a first panel and a second panel, the front of the second panel being glued to the back of the first panel. The first panel has square holes shaped to frame photographs, the overlay forming windows over the holes. The second blank has slits for receiving photographs between the first and second panels behind the windows.

U.S. Pat. No. 4,571,867 patented Feb. 25, 1986 by M. E. Williams describes a sheet having pairs of upward diverging slits. The outer ends of the slits are spaced from the adjacent edges of the sheet and are the entrance openings for pockets. The lower ends of the slits terminate short of convergency. The bottom edge of card that is inserted into a pair of slits first enters the entrance openings and then moves down until it is stopped by the lower end termination of the slits. A pinch crease of contracting material of the sheet is formed between and spaced from the near terminal ends of each pair of downwardly converging slits to pull the sections of sheet material that contains the slits in order to cause the legs of sheet material formed between the slits to twist and partially open the slits for easier insertion of cards into the slits.

U.S. Pat. No. 5,199,743 patented Apr. 6, 1993 by A. B. Rosinski describes a sheet die cut and folded to form two similar side by side pockets. The sheet is folded on a line into two panels, which we shall call panel A and panel B, which are glued together along a strip that extends normal to the fold line and is at the center of each panel. One pocket is formed by a slot in panel B that extends from the glued strip to the lateral edge of panel B. The pocket can bulge up from the glued surface at a flex line (line 60, FIG. 1) along the glued strip. The other pocket is formed by a slot in panel B that extends from the glued strip to the other lateral edge of panel B, and can bulge up from the glued surface at a flex line along the glued strip. A tab extends from each lateral edge of panel B and folds along the lateral edge. The tab is folded so that it can be glued to panel A between panel A and B when panel B is folded against panel A and is also glued to panel A.

In FIG. 1 die cut sheet 26 of PRIOR ART folder 20 folds on fold line 28 forming panels 22 and 24. Slits 30 and 32 which are transverse to fold line 28 receive cardboard back 36 of a pad, or other papers. Bottom edge 40 of the cardboard passes behind section 42 of panel 22 and inserts into oblique slits 44, 46.

Transverse slits 30, 32 and 44 do not go to the fold line. Slit ends 52, 54, 56 and 58 are spaced from fold lines. The slits or narrow slots have small radius ends or V-shaped ends which tend to rip 48 at ends 52, 54 and 56 from force of forward expansion of the pocket by papers in the pocket, by wear by the papers at the ends of the slits, and by fatigue of the ends of the slit. Slit 46 has large-radius circular punched out ends 58 which lessens ripping from stretching or fatigue.

SUMMARY OF THE INVENTION

It is one object of the invention to provide book sheet having a slit opening pocket.

It is another object of the invention to provide a die cut sheet book sheet having a slit opening pocket.

It is another object that the slit opening pocket does not tear at the ends of the slit from expansion of the opening by bulk of inserted materials, or from fatigue of the ends of the slit, or from wear by papers to the ends of the slit.

It is another object that the slit opening pocket has a pair of lateral side walls attached to the ends of the slits.

It is another object that the slit opening pocket has a front wall, a back wall, and a pair of side walls attached to the ends of the slits and connecting the front wall to the back wall.

Other objects and advantages will become obvious to a reader of the ensuing description.

A sheet mounted in a book includes a first fold line forming a first panel, and a second fold line forming a second panel, and a third panel. A slit in the third panel that is configured for receiving an item through the third panel goes to the first fold and the second fold. The first fold is at an angle of 90 degrees or less between the first panel and the third panel. The second fold is at an angle of 90 degrees or less between the second panel and the third panel. In one design the sheet is punched for mounting in a loose-leaf binder.

Describing the invention another way, a pocket liner includes a sheet which includes a first fold and a second fold, a slit in the sheet configured for receiving an object through the sheet extends to the first and second folds so that each of the folds is transverse to the slit at the fold. First and second panels extend respectively from the first and second folds so that when the sheet is folded on the first and second folds the slit opens into a first pocket bounded at the opening by the first and second folds. A second pocket having an opening transverse to the slit and adjacent to the first pocket opening is formed by the folding on the first and second folds. A third fold configured to close the bottom of the first pocket and a side of the second pocket is generally parallel to the length of the slit. The first and second panels traverse the slit behind the slit.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
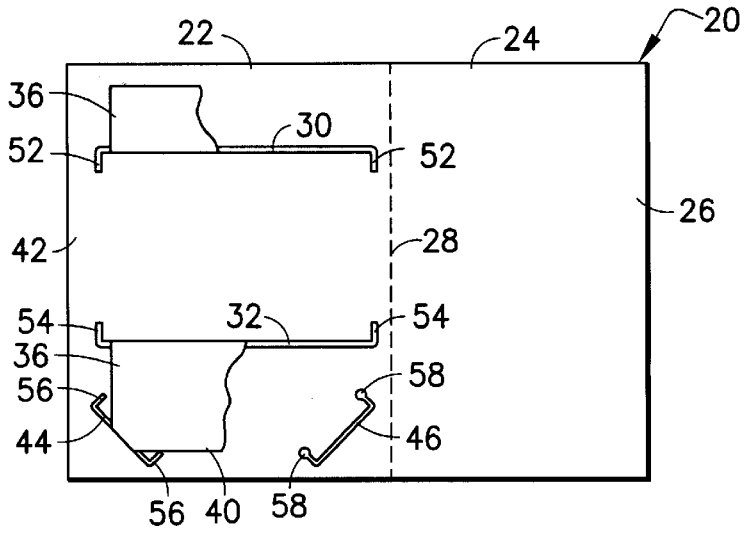
FIG. 1 PRIOR ART
FIG. 1 is a PRIOR ART folder.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
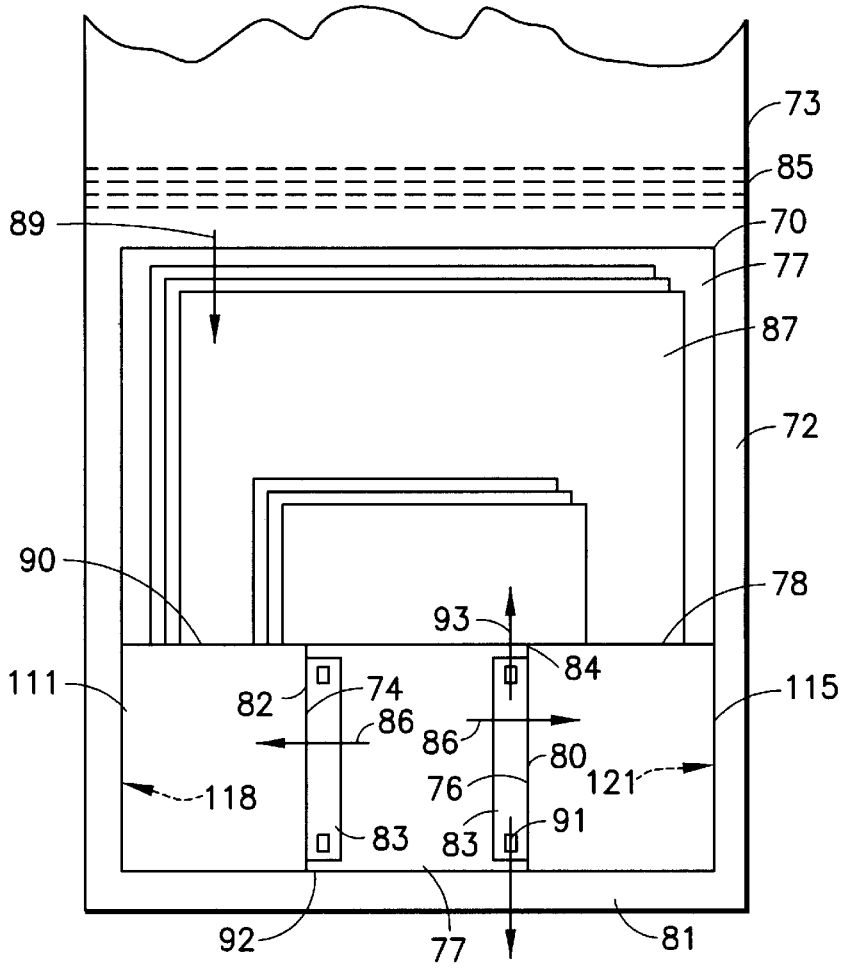
FIG. 2 is a front view of an album cover having a liner of the present invention.
Figure 3:
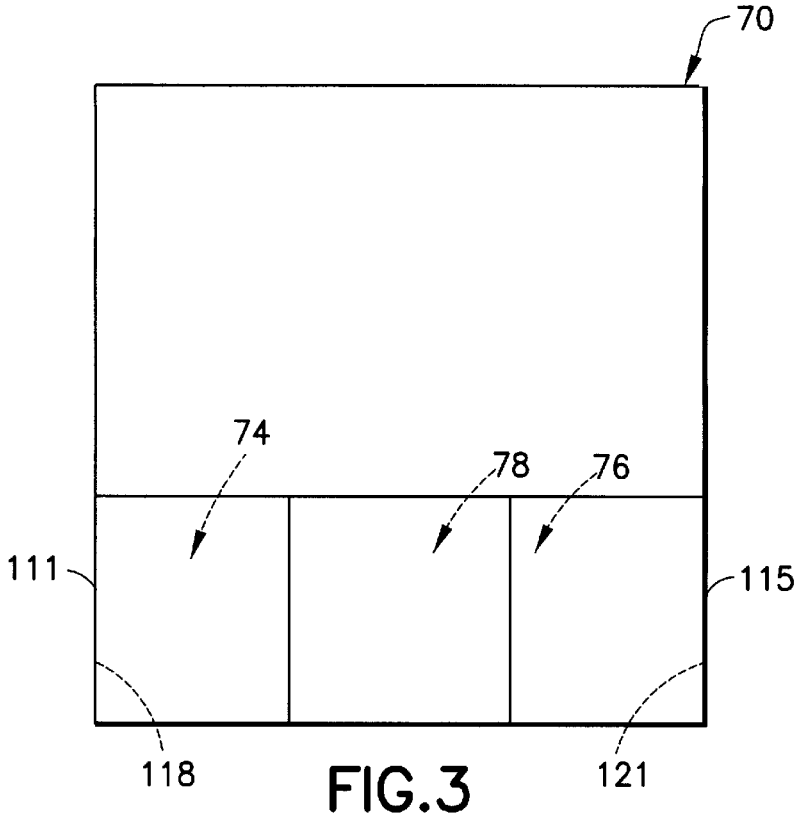
FIG. 3 is a front view of the liner of FIG. 2.
Figure 4:
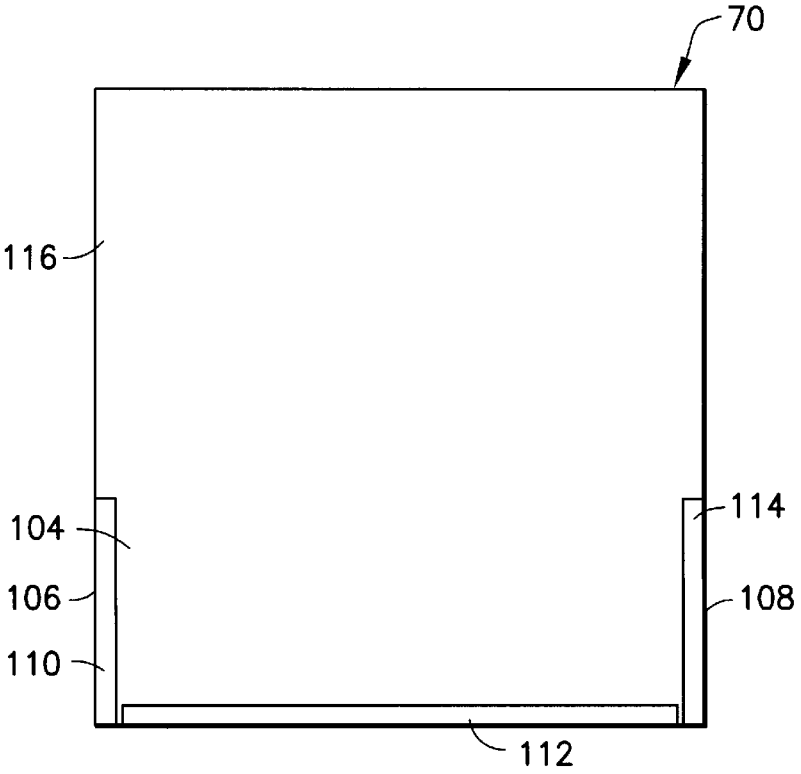
FIG. 4 is a rear view of the liner of FIG. 2.

Referring to FIG. 2, liner 70 made from a die cut sheet 77 covers right cover 72 of album 73. The liner has pockets 74, 76, and 78. Pockets 74 and 76 have computer disks 83 inserted laterally 86 into the pockets, and pocket 78 contains a pack of paper sheets 87 inserted vertically 89.

The sheets of paper inserted into pocket 78 extend behind pockets 74 and 76 and are separated by die cut sheet 77 material from the disks inserted into pockets 74 an d 76. The three pockets 74, 76 and 78, therefore, are independent of one another.

Figure 5:
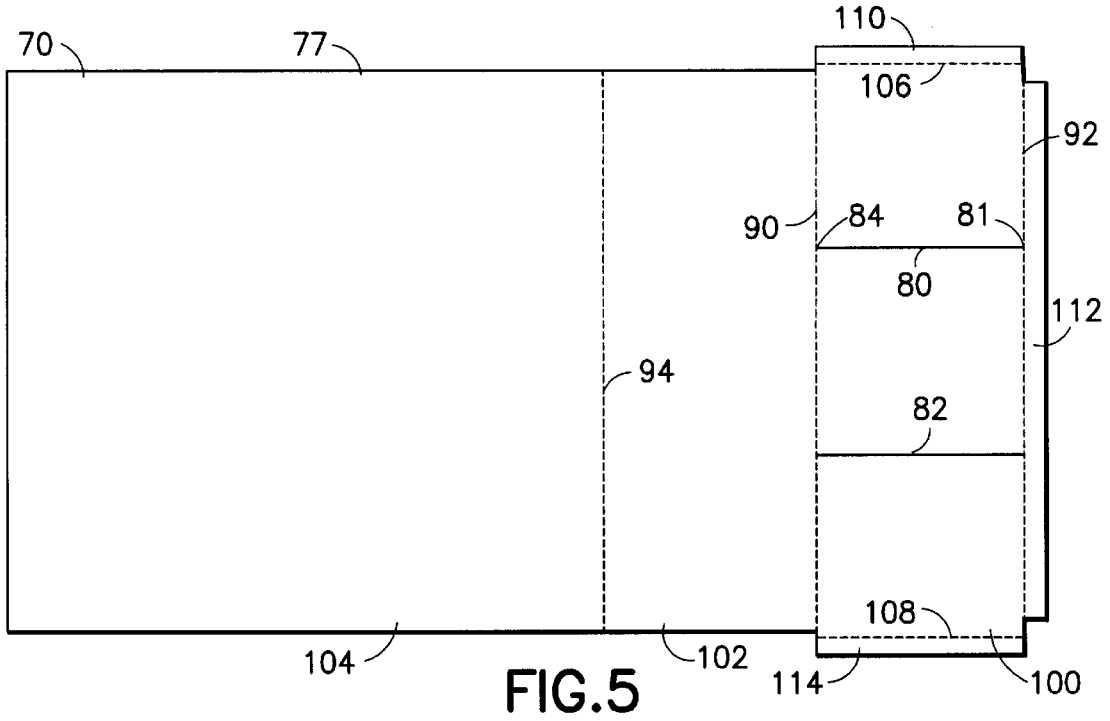
FIG. 5 is a front view of the die cut sheet of FIG. 2.
Figure 6:
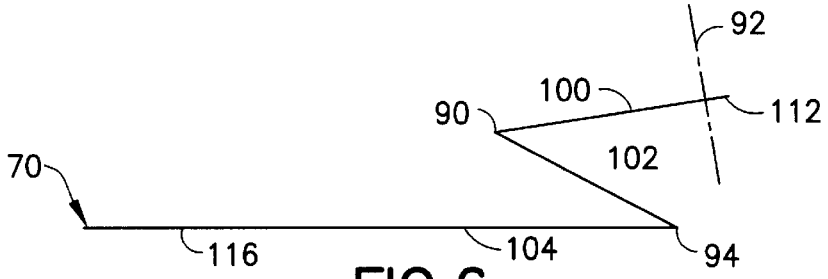
FIG. 6 is a side view of the die cut sheet of FIG. 2, partially folded.
Figure 7:
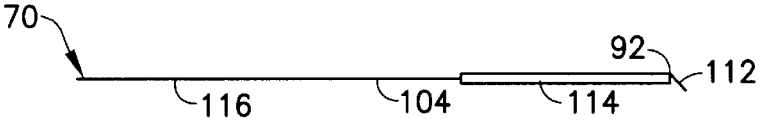
FIG. 7 is a side view of the die cut sheet of FIG. 2, partially folded.
Figure 8:
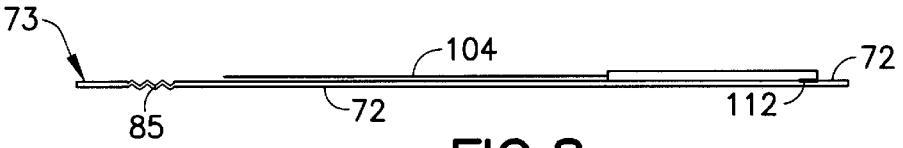
FIG. 8 is a side view of the die cut sheet of FIG. 3 mounted on the album cover.

In FIG. 5, die cut sheet 77 has two separate slits 80, 82 which extend each from fold 90 to fold 92. The slits are cut through the sheet by any convenient method including slitting and die cutting of the sheet. The slits are spaced from each other and are independent of each other.

The term "slit" in this disclosure and claims means a slit or a slot in which the ends terminate in a very small radius, V-shape, or other narrow shape.

Referring to FIGS. 2–8, the sheet is folded through acute angles on folds 90, 92 and 94 until panels 100, 102 and 104 are sandwiched together. Then flaps 110, 112, and 114 are folded through acute angles and glued to the back 116 of panel 104. Folds 106 and 108 of flaps 110 and 114 simultaneously seal the left and right edges 111, 115 of vertical pocket 78, and the bottoms 118, 121 of lateral pockets 74 and 76.

Fold 92 forms a side wall that intersects end 81 of slit 80 transverse to the length of the slit and prevents objects in the pocket from moving longitudinally 91 past the end of the slit and tearing the end of the slit longitudinally. It also prevents the objects tearing the end of the slit longitudinally by applying wear to the end of the slit, or by excessively fatiguing the end of the slit.

Fold 90 makes a side wall that intersects end 84 of slit 80 transverse to the length of the slit and prevents objects in the pocket from moving longitudinally 93 past the end of the slit and tearing the end of the slit longitudinally. It also prevents the objects tearing the end of the slit longitudinally by applying wear to the end of the slit, or by excessively fatiguing the end of the slit.

Folds 92 and 90 also form side walls that intersect the ends of slit 82 transverse to the length of the slit, and prevent longitudinal ripping of the slit beyond the ends of the slit.

The liner is attached to cover 72 of album 73 adjacent to spine 85 of the album by gluing back 116 to the cover.

The openings of pockets 74 and 76 cannot enlarge by tearing laterally because slits 80, 82 go to folds which are transverse to the slits and form end walls transverse to the length of the slit. Preferably the fold is to an angle of 90 degrees or less. Slits 80, 82 go to folds 90, 92, and stop at the fold. It should be understood that in going to a fold the slit may pass through the fold line without departing from the meaning and scope of the invention.

Figure 9:
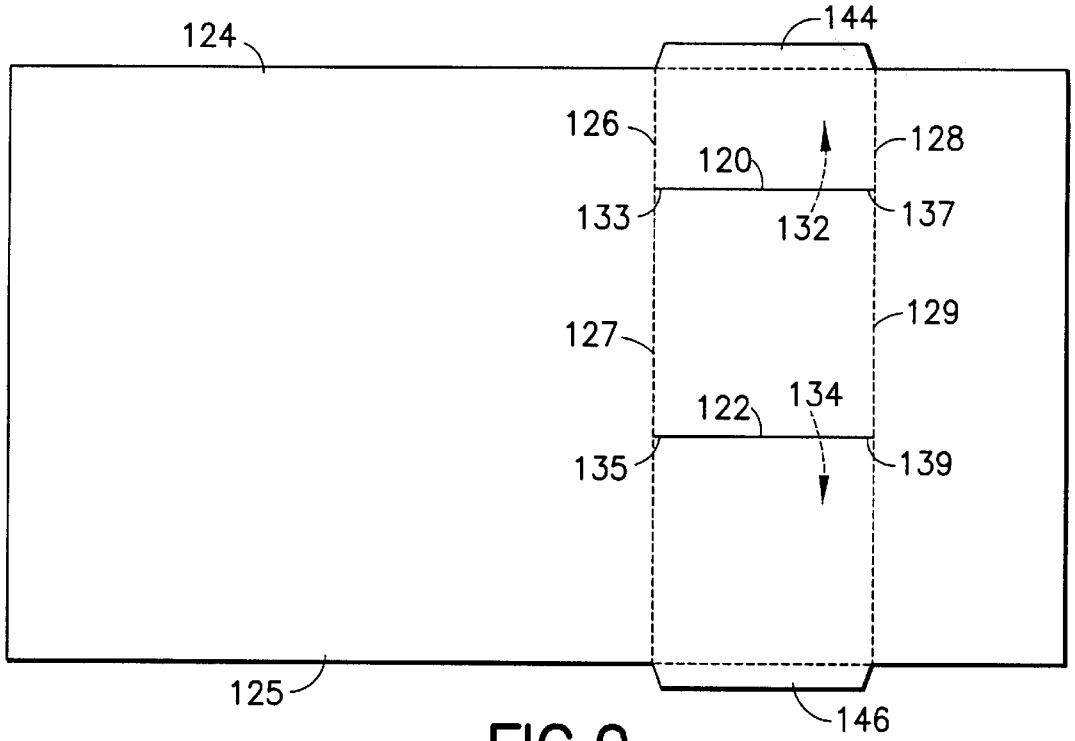
FIG. 9 is a back view of a precut sheet of another liner of the present invention.
Figure 10:
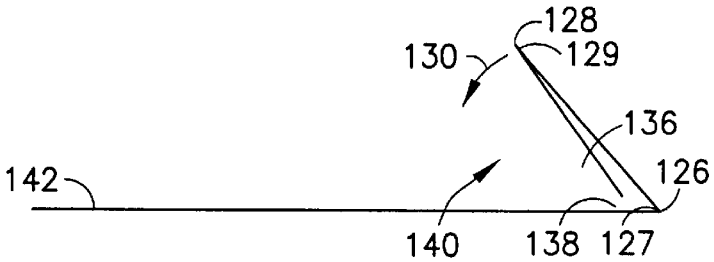
FIG. 10 is a side view of the precut sheet of FIG. 9, partially folded.
Figure 11:
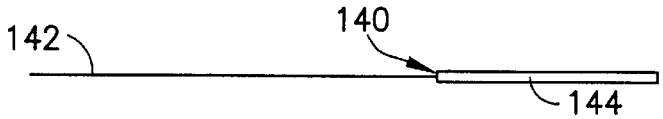
FIG. 11 is a side view of the precut sheet of FIG. 9, partially folded.
Figure 12:
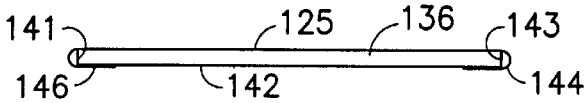
FIG. 12 is an end view of the precut sheet of FIG. 11.
Figure 13:
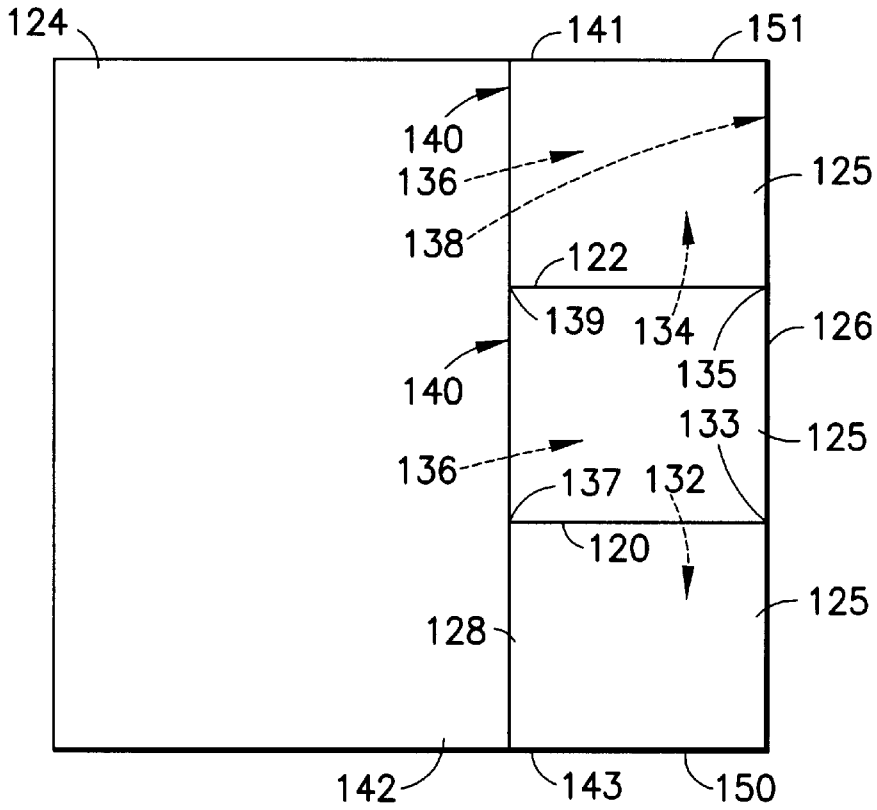
FIG. 13 is a front view of the folded liner of FIG. 9.

In FIGS. 9–13 slits 120 and 122 in die cut sheet 124 go or extend to folds 126 and 128. FIG. 9 shows the back 125 of sheet 124.

When the sheet is folded 130, the slits provide lateral pockets 132, 134, for receiving items and folds 128 and 126 provide the opening 136 and bottom 138 respectively of pocket 140 on the front 142 of the die cut sheet. Small panels or tabs 144 and 146 close and seal edges 141 and 143 of vertical pocket 140 and the bottoms edges 150, 152 of each of the lateral pockets.

Fold wall 127 at the apex of fold 126 prevents items inserted in slits 120 and 122 of pockets 132 and 134 from moving longitudinally past ends 133 and 135 of the slits and extending the slits longitudinally by tearing them.

Fold wall 129 at the apex of fold 128 prevents items inserted in slits 120 and 122 from moving past ends 137 and 139 of slits 120 and 122 so that the ends do not extend longitudinally by tearing.

Figure 14:
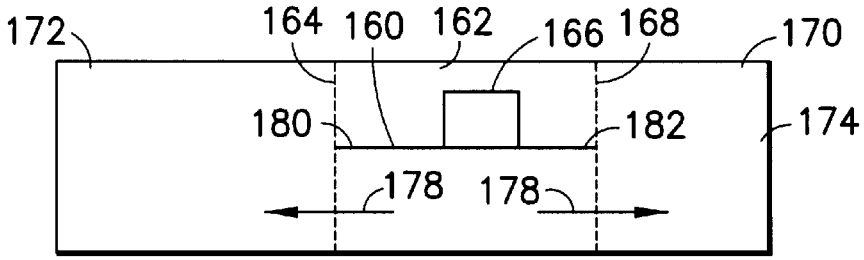
FIG. 14 is a front view of a liner of the invention.

Referring to FIG. 14, in sheet 170, slit 160 in panel 162 configured for receiving an item 166 through the panel goes to folds 164 and 168 with adjacent panels 172 and 174. Fold 164 between panel 172 and panel 162 having slit 160 going to fold 164 prevents the item inserted in slit 160 from moving longitudinally 178 past end 180 of the slit when fold 164 is within the range of 90 degrees to an acute angle, that is panel 172 is at an angle in the range of 90 degrees or less to adjacent panel 160.

Figure 15:
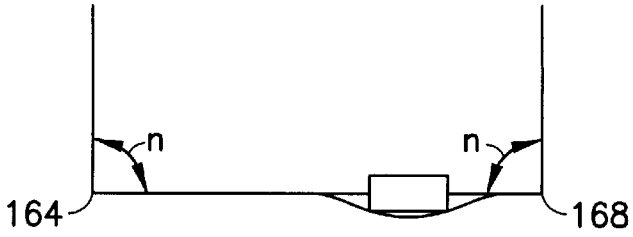
FIG. 15 is a top view of the liner of FIG. 14, folded.
Figure 16:
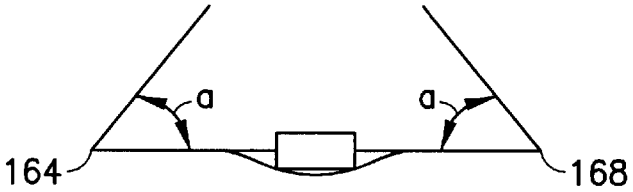
FIG. 16 is a top view of the liner of FIG. 14, folded.
Figure 17:
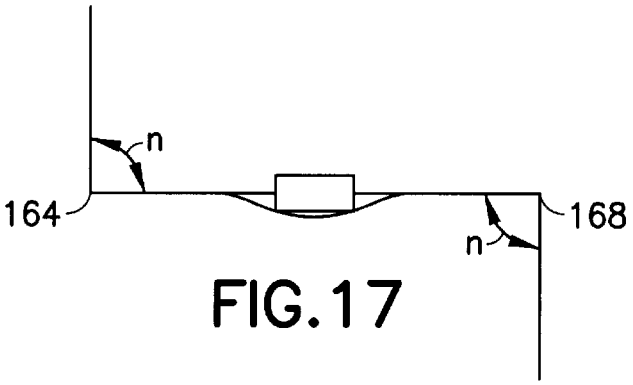
FIG. 17 is a top view of the liner of FIG. 14, folded.
Figure 18:
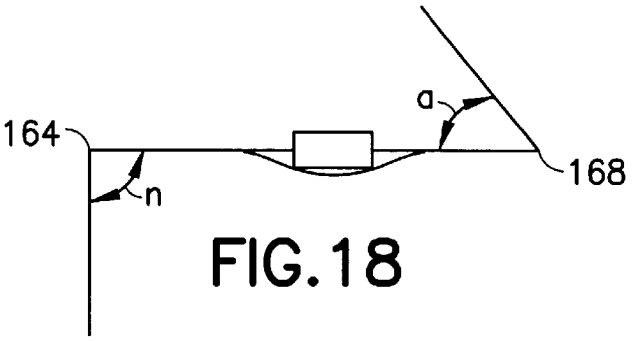
FIG. 18 is a top view of the liner of FIG. 14, folded.

Longitudinal tear of slit 160 beyond ends 180, 182 by an item in slit 160 is prevented by folds 164 and 168 when each fold is at 90 degrees n, FIGS. 15 and 17 show two examples, and when each fold is acute a, FIG. 16 showing an example, and when one of the two folds is 90 degrees and the other is acute, FIG. 18 showing example.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. A pocket liner comprising:

a sheet, a first fold on said sheet forming a first panel of said sheet, a second fold on said sheet forming a second panel of said sheet, a third panel of said sheet, a slit in said third panel configured for receiving an item through said third panel, said slit extending to each of said first fold and said second fold so that each of said first fold and said second fold is transverse to said slit, said first fold being at an angle of 90 degrees or less between said first panel and said third panel, and said second fold being at an angle of 90 degrees or less between said second panel and said third panel.

2. A pocket liner comprising:

a sheet, a first fold on said sheet forming a first panel of said sheet, a second fold on said sheet forming a second panel of said sheet, a third panel of said sheet, a slit in said third panel configured for receiving an item through said third panel, going to said first fold and said second fold, said first fold being at an angle of 90 degrees or less between said first panel and said third panel, and said second fold being at an angle of 90 degrees or less between said second panel and said third panel, said sheet being punched for mounting in loose-leaf binder means.

3. A pocket liner comprising:

a sheet, a first fold on said sheet forming a first panel of said sheet, a second fold on said sheet forming a second panel of said sheet, a third panel of said sheet, a slit in said third panel configured for receiving an item through said third panel, going to said first fold and said second fold, said first fold being at an angle of 90 degrees or less between said first panel and said third panel, and said second fold being at an angle of 90 degrees or less between said second panel and said third panel, said sheet being in a book.

4. In an element for a book comprising a sheet having a slit having a length and being configured for receiving an item through the sheet, said slit going to two folds of said sheet along fold lines that are transverse to said slit, said folds being at angles that are 90 degrees or less, to prevent excessive wear and lengthwise tear of said slit.

5. A pocket liner comprising:

a sheet comprising a first fold and a second fold, a slit in said sheet, said slit having a length, a back, being configured for receiving an object through said sheet, and extending to the first and second folds so that each of the folds is transverse to said slit, first and second panels extending respectively from the first and second folds so that when said sheet is folded on the first and second folds, said slit opens into a first pocket bounded at the slit by the first and second folds.

6. The pocket liner of claim 5, wherein a second pocket having an opening transverse to said slit and adjacent to said first pocket opening is formed by folding on the first and second folds.

7. The pocket liner of claim 6, further comprising a third fold configured to close a bottom of said first pocket and a side of said second pocket.

8. The pocket liner of claim 7 wherein said third fold is generally parallel to the length of said slit.

9. The pocket liner of claim 6 wherein said first and second panels traverse said slit behind said slit.

10. A sheet mounted in a book said sheet comprising a first fold and a second fold, a slit in said sheet, said slit having a length, a back, being configured for receiving an object through said sheet, and extending to the first and second folds so that each of the folds is transverse to said slit at the fold, first and second panels extending respectively from the first and second folds so that when said sheet is folded on the first and second folds, said slit opens into a first pocket bounded at the slit by the first and second folds.

11. The sheet of claim 10, wherein a second pocket having an opening transverse to the slit and adjacent to said first pocket opening is formed by folding on the first and second folds.

12. The sheet of claim 11, further comprising a third fold configured to close a bottom of said first pocket and a side of said second pocket.

13. The sheet of claim 12 wherein said third fold is generally parallel to the length of said slit.

14. The sheet of claim 11 wherein said first and second panels traverse said slit behind said slit.

15. The sheet of claim 10 further comprising holes in said sheet configured for removably attaching said sheet to said book.

* * * * *